US011118557B2

(12) United States Patent
Pierantozzi

(10) Patent No.: US 11,118,557 B2
(45) Date of Patent: Sep. 14, 2021

(54) CENTRIFUGAL KINETIC POWER TURBINE

(71) Applicant: Ronald Pierantozzi, Pompton Plains, NJ (US)

(72) Inventor: Ronald Pierantozzi, Pompton Plains, NJ (US)

( * ) Notice: Subject to any disclaimer, the term of this patent is extended or adjusted under 35 U.S.C. 154(b) by 0 days.

(21) Appl. No.: 17/175,838

(22) Filed: Feb. 15, 2021

(65) Prior Publication Data

US 2021/0164433 A1 Jun. 3, 2021

(51) Int. Cl.
*F03B 7/00* (2006.01)

(52) U.S. Cl.
CPC ..... *F03B 7/00* (2013.01)

(58) Field of Classification Search
CPC .. F03B 7/00; F03B 13/08; F03B 11/02; F03B 11/004; F03B 11/025; F03D 3/04; F03D 3/0409; F03D 3/0418
See application file for complete search history.

(56) References Cited

U.S. PATENT DOCUMENTS

| | | | | |
|---|---|---|---|---|
| 3,973,869 | A | 8/1976 | Doll et al. | |
| 5,873,700 | A | 2/1999 | Ichikawa | |
| 8,154,145 | B2 * | 4/2012 | Krauss | F03D 9/11 290/54 |
| 8,210,805 | B1 * | 7/2012 | Osborne | F03B 7/00 415/203 |
| 9,000,604 | B2 | 4/2015 | Sireli et al. | |
| 10,605,224 | B2 * | 3/2020 | Oh | F03B 13/264 |
| 2012/0099977 | A1 | 4/2012 | Churchill et al. | |
| 2013/0294885 | A1 | 11/2013 | Churchill | |
| 2015/0014996 | A1 | 1/2015 | Siltala | |
| 2018/0023539 | A1 * | 1/2018 | Oh | F03B 15/06 416/181 |
| 2018/0313320 | A1 | 11/2018 | Nakamura et al. | |

FOREIGN PATENT DOCUMENTS

GB 2504362 A * 1/2014 ..... F03B 17/063

OTHER PUBLICATIONS

Maldar, Nauman Riyaz et al. "A review of the optimization studies for Savonius turbine considering hydrokinetic applications." Energy Conversion and Management 226 (2020) 113495 [date accessed: Dec. 29, 2020].

* cited by examiner

*Primary Examiner* — Justin D Seabe
*Assistant Examiner* — Ryan C Clark
(74) *Attorney, Agent, or Firm* — Michael J. Feigin, Esq.; Feigin and Fridman LLC

(57) ABSTRACT

A turbine has a rotatable outer casing with an inlet and an outlet therein. A casing rotation control causes the casing to rotate about a central point thereof such that the inlet consistently faces an incoming flow of ambient fluid. The casing has two spaced-apart portions in shapes of oppositely-disposed concave arcs (also referred to as "deflector plates" of a same circle. In some embodiments, each concave arc of the casing forms a unitary structure with a respective convex arc, the two spaced-apart convex arcs lying on either side of the outlet. In some embodiments, each concave arc is connected to a respective second concave arc at an endpoint thereof, the second concave arcs being rotatable about the point of connection.

11 Claims, 7 Drawing Sheets

CENTRIFUGAL KINETIC POWER TURBINE

FIELD OF THE DISCLOSED TECHNOLOGY

The disclosed technology relates to Fluid turbines, and more specifically, a turbine meant to be placed in open air and waters to power machinery requiring mechanical energy.

BACKGROUND

One of the more pressing concerns today is how to produce power from safe, renewable energy in small to large applications effectively at low cost. One abundant source of renewable energy is Kinetic Energy (energy of mass in motion). Hydro and wind power is obtained by way of fluid turbines. Some fluid turbines have an outer casing with a single inlet and a single outlet. When the inlet has some form of fluid with relatively higher pressure to the outlet, the turbine spins and produces power.

Thus, there is a need for a fluid turbine which will produce a consistently high level of power regardless of the direction of fluid flow. This and other problems are solved by embodiments of the disclosed technology, as described below.

SUMMARY OF THE DISCLOSED TECHNOLOGY

A turbine of embodiments of the disclosed technology has a plurality of internal blades, a top plate, a bottom plate, a shaft, a two-part rotatable side wall casing, and a casing rotation control. Each part of the rotatable casing is spaced apart from one another and extends between the top plate and the bottom plate, forming a substantially watertight seal there-between.

"Turbine" is defined as a machine for producing continuous power by way of continuous revolution of a wheel or rotor fitted with vanes, the movement being caused by a fast-moving flow of water, steam, gas, air, or other fluid. "Rotatable" is defined as capable of turning at least 360 degrees without breaking. "Watertight" or "water-tight" is defined as being closely sealed, fastened, or fitted so that substantially no fluid enters or passes there-through.

In some embodiments, the casing has two, separate, oppositely disposed concave arcs of a same circle, each respective arc forming a unitary structure with a respective convex arc. Each respective convex arc is smaller than its respective concave arc.

The casing may be functionally connected to the turbine, such that the casing and the turbine rotate with a same rotational axis. The turbine rotates such that the concave portions of the Turbine blade face an area of flow of relatively higher pressure along with the concave portions of the Turbine blade face an area of flow of relatively lower pressure (compared to the area of flow of relatively higher pressure).

The casing, in various embodiments, has two openings: an inlet and an outlet. The inlet and outlet are oppositely disposed. A distance between a first side edge of the inlet and an adjacent side of the outlet may be shorter than a distance between a second side edge of the inlet and an adjacent side of the outlet. "Inlet" is defined as an area of entry into an interior thereof, and "outlet" is defined as an area of exit from an interior thereof. "Interior" is defined as any area within a circle on whose circumference the portions of the outer casing lie.

The turbine, in embodiments, rotates in response to a measured direction of flow of fluid. A fixed casing would be used in cases of one direction flow of fluid. In an open area of fluid, that direction of flow can change, a rotating casing is needed to rotate around the Turbine blades and shaft. Using a casing rotation control to cause the turbine casing to rotate based on detecting a water flow direction and mechanically rotate the casing along with the change of fluid flow direction. More specifically, the casing rotation control may cause the turbine casing to rotate such that the casing inlet faces an incoming flow of fluid. "Fluid" is defined as a substance without fixed shape, which yields easily to pressure, and which surrounds at least a portion of the turbine.

The casing, in some embodiments, has two, separate, oppositely-disposed concave arcs of a same circle, each respective arc forming a unitary structure with a respective convex arc. The outlet is a space between the two convex arcs, and the inlet is a space between endpoints of the two separate, oppositely-disposed concave arcs of the same circle (which are opposite the convex arcs).

The casing may further have a pair of other concave arcs, each connected at an endpoint thereof to an endpoint of a concave arc of the casing, the endpoint of the concave arc being opposite the convex arc thereof. These other concave arcs may be rotatable about a point of connection to a respective concave arc of the casing. These other concave arcs, when in a closed position, may form an unbroken arc with both concave arcs of the casing, and when in an open position, may form an acute angle with a respective adjacent concave arc of the casing.

The turbine, in various embodiments of the disclosed technology, is fixed at least one point, such that it moves at a velocity which is lower than that of a surrounding fluid medium.

Also disclosed herein is a method of using the above-described turbine, the turbine having a plurality of internal blades, a top plate, a bottom plate, a shaft, a two-part rotatable casing, and a casing rotation control. Each part of the rotatable casing is spaced apart from one another and extends between the top and bottom plates, forming a substantially water tight seal there-between.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

A turbine has a rotatable outer casing with an inlet and an outlet therein. A casing rotation control causes the casing to rotate about a central point thereof such that the inlet consistently faces an incoming flow of ambient fluid. The casing has two spaced-apart portions in shapes of oppositely-disposed concave arcs of a same circle. In some embodiments, each concave arc of the casing forms a unitary structure with a respective convex arc, the two spaced-apart convex arcs lying on either side of the outlet. In some embodiments, each concave arc is connected to a respective second concave arc at an endpoint thereof, the second concave arcs being rotatable about the point of connection.

One of the object of the disclosed technology is to use existing centrifugal force to help capture mechanical energy. When energy of mass in motion (kinetic energy) is mechanically captured and forced centrifugally on an axis by the captured kinetic energy, existing energy from water flow is converted into centrifugal kinetic energy.

Embodiments of the disclosed technology will become clearer in view of the following discussion of the figures.

Figure 7:
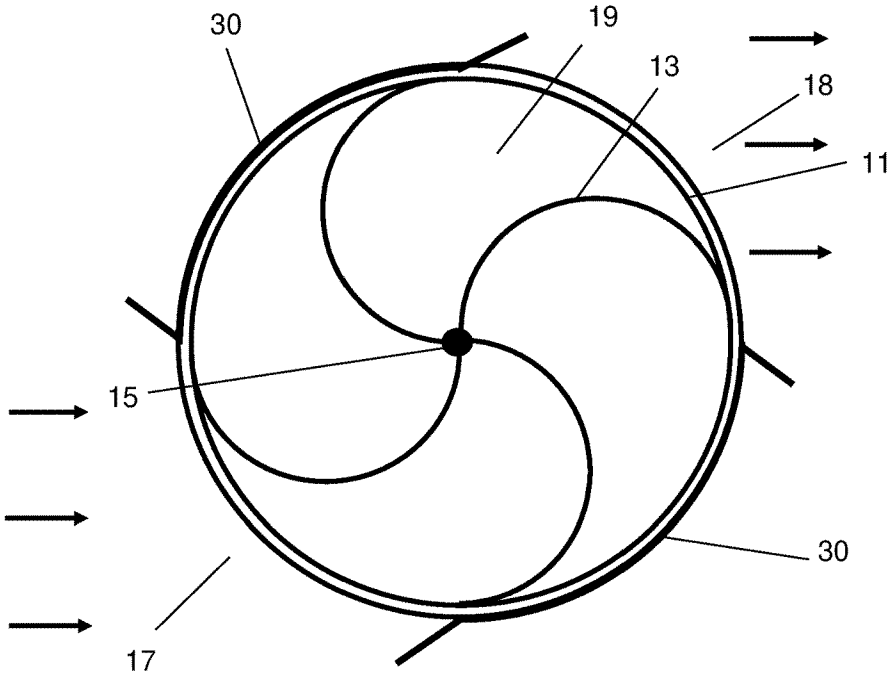
FIG. 7 is a top plan view of the turbine and walls of casing of FIG. 3 with arrows showing a direction of fluid flow there-about.
Figure 10:
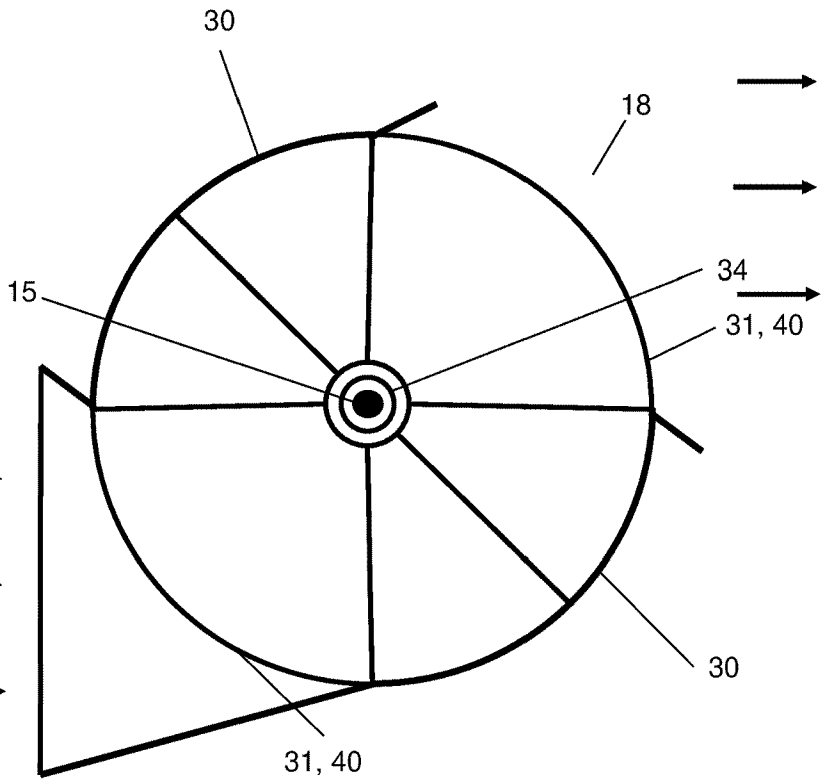
FIG. 10 is a top and bottom plan view of the casing of FIG. 6 with arrows showing a direction of fluid flow there-about.
Figure 9:
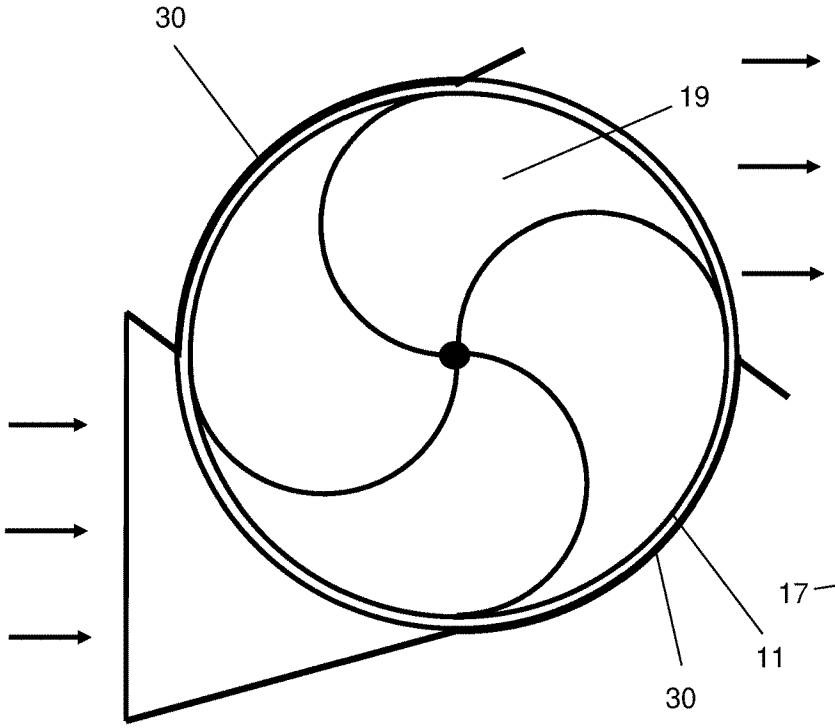
FIG. 9 is a top plan view of the turbine and walls of casing of FIG. 5 with arrows showing a direction of fluid flow there-about.

FIG. 7 is a top plan view of a turbine of embodiments of the disclosed technology. In this embodiment, the turbine 11 has an outer casing 30 which is made of two separate parts. A first part of the casing 30, in the embodiment shown, is smaller than a second part thereof. In other embodiments, the two parts of the casing 30 are substantially identical in shape and size. The two parts of the casing 30 are in shapes of concave arcs lying in a same circle. In other embodiments, the two parts of the casing 30 may be in other shapes or may be in shapes of arcs not in a same circle. "Concave" is defined with respect to the outer casing 30 as curving away from a central point of the turbine, such that a radius emanating from a central point of the turbine to each point along the curve is substantially identical.

A inlet 17 exists in a first gap between the two parts of the casing 30. An outlet 18 exists in a second gap between the two parts of the casing 30. In the embodiment shown, the inlet 17 and the outlet 18 are arcs lying in the same circle as the parts of the casing 30. In the embodiment shown, the four segments including the inlet 17, the outlet 18, and the two parts of the casing 30 form a substantially complete circle. In other embodiments, the two parts of the casing 30 may be more than two parts or may be a single unitary part with gaps therein.

Within the turbine 11 are blades 13 In the embodiment shown, the turbine 11 includes four blades 13 which are substantially identical in size and shape. In other embodiments, the turbine 11 may have a different number of blades, some or all of which may be of different shapes and/or sizes. In the embodiment shown, the blades 13 are curvilinear. Each blade 13 has a convex side thereof facing a concave side of a blade 13 adjacent thereto and has a concave side thereof facing a convex side of a blade 13 adjacent thereto. An outermost edge of each blade 13 is flush with an inner side of the casing 20 when the outer edge of the blade 13 is between a portion of the casing 30 and the central point 15. "Flush" is defined as being even and/or level with.

Said another way, a centrifugal turbine blade assembly, shaft, casing and casing rotation control (CRC) are used to capture energy of water flow. In some embodiments, the energy is from air flow. The casing, in some embodiments of the disclosed technology, fully encloses the turbine assembly except at an inlet and outlet. The connected casing pivots along with the turbine shaft axis using bearings and/or separate track mechanism which controls the casing direction position with a CRC. The CRC can be a fluid direction vane connected to the casing or a mechanically separate controlling device that moves the casing position using motors, gears, tracks and/or by any other means.

When the device, as a whole, is mounted to a foundation or anchored in a stationary position in the area of fluid flow, the casing inlet side is turned into oncoming flow of fluid by the CRC. The CRC controls the angle of entry of the casing and focuses the flow of fluid on to the back side of the turbine advancing blade to start and run the turbine in embodiments of the disclosed technology. The CRC can also be used to stop the turbine by turning the casing to block flow to the back of the advancing blade.

The casing and turbine blades can capture portions of the surrounding kinetic energy in motion. This captured energy in motion is also forced by the outside surrounding kinetic energy centrifugally on an axis and released resulting centrifugal kinetic energy (rotation of the blades).

Figure 2:
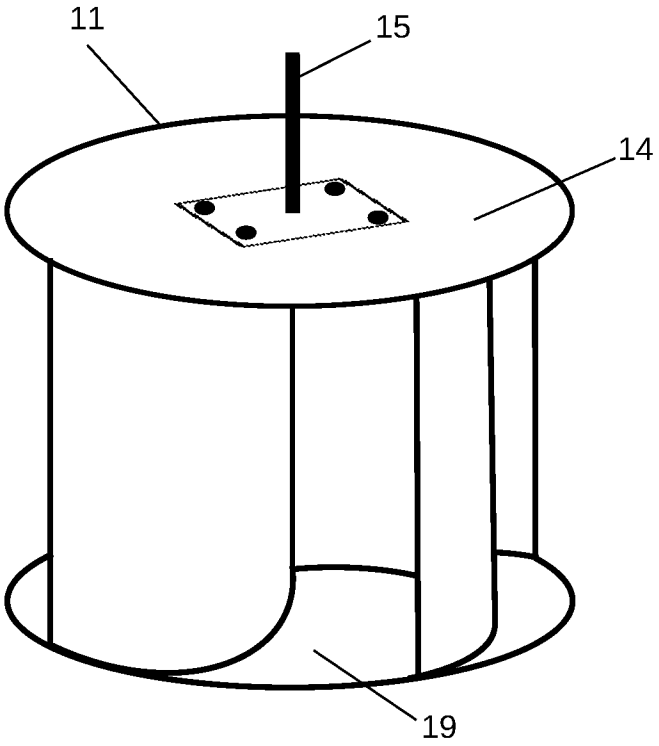
FIG. 2 is a front perspective view with shaft on top turbine of embodiments of the disclosed technology.
Figure 1:
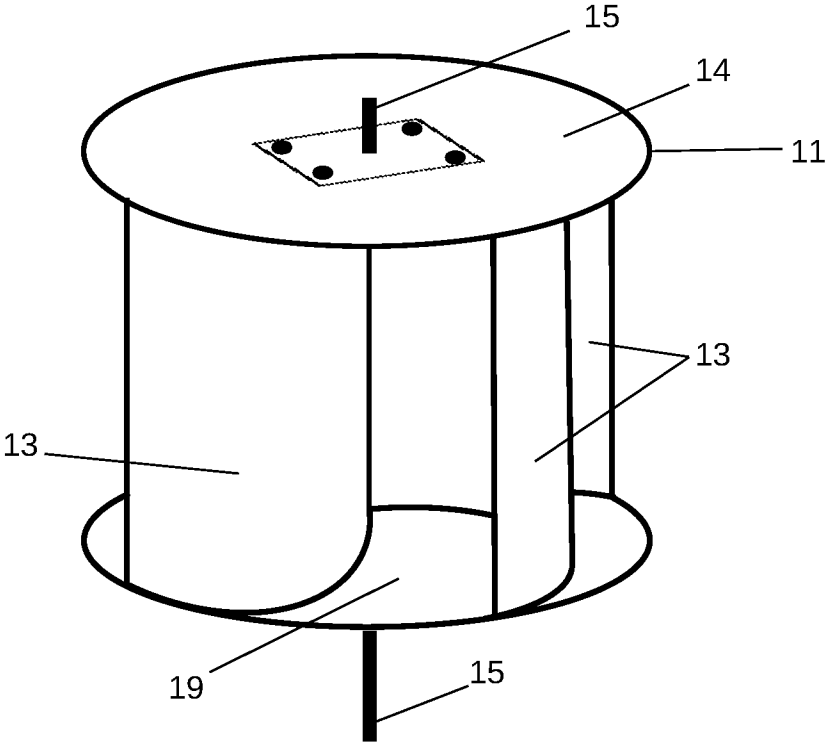
FIG. 1 is a front perspective view with shaft on bottom of a turbine of embodiments of the disclosed technology.
Figure 4:
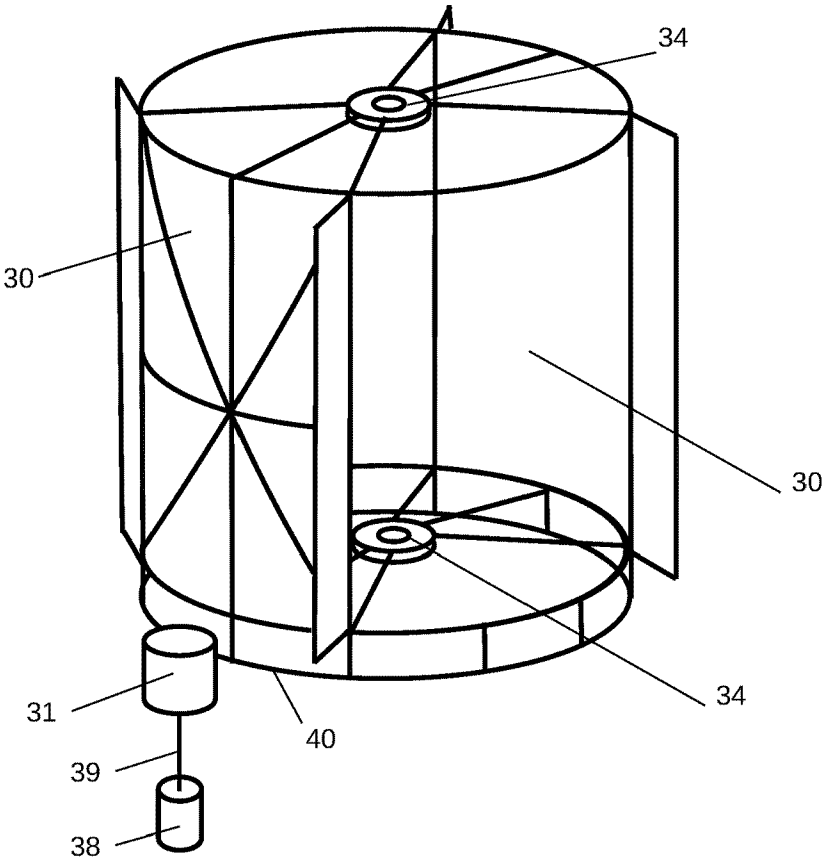
FIG. 4 is a front perspective view with drive and control end on bottom of the turbine casing assembly.
Figure 3:
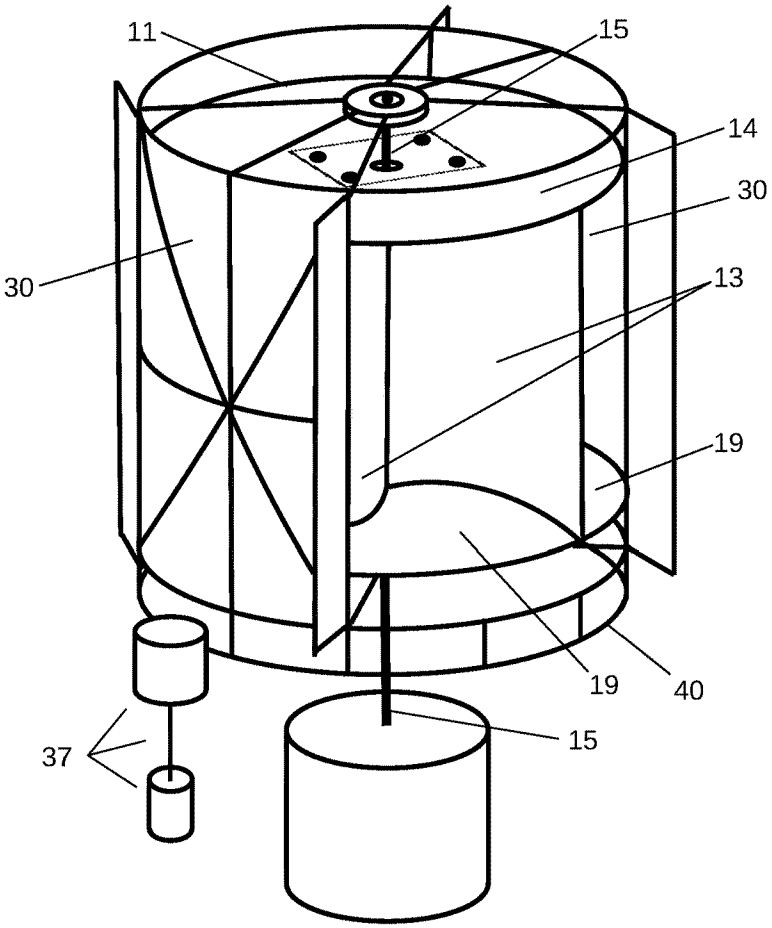
FIG. 3 is a front perspective view with drive and control end on bottom of the turbine and casing.
Figure 6:
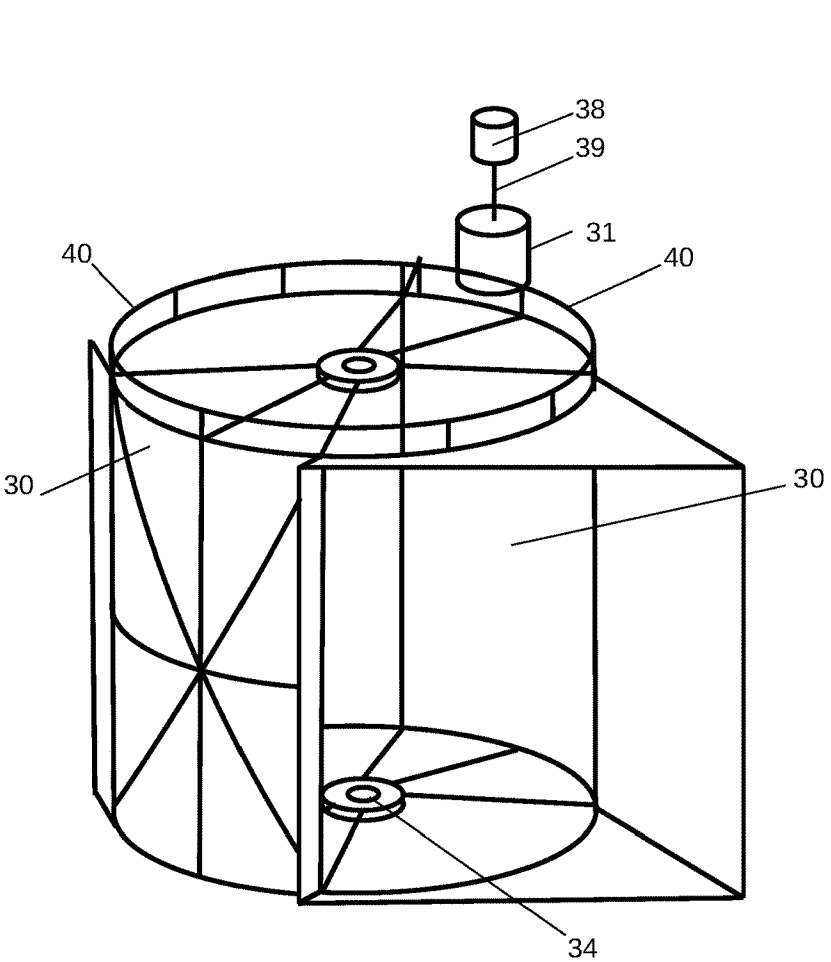
FIG. 6 is a front perspective view with drive and control end on top of the turbine casing assembly with a ducted inlet.
Figure 5:
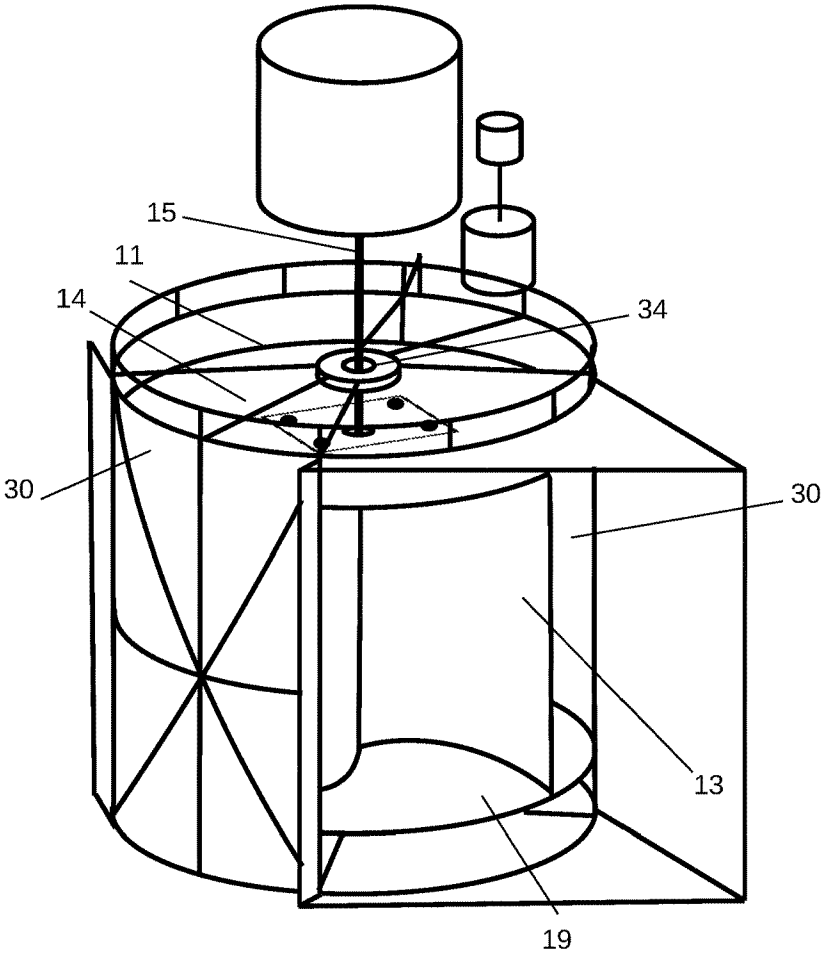
FIG. 5 is a front perspective view with drive and control end on top of the turbine and casing.
Figure 8:
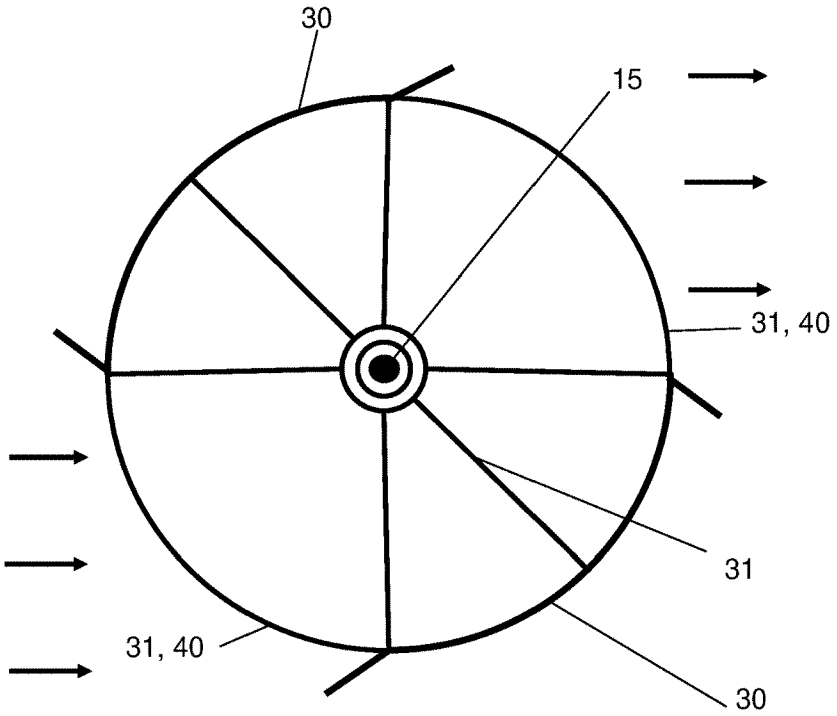
FIG. 8 is a top and bottom plan view of the casing of FIG. 4 with arrows showing a direction of fluid flow there-about.

FIG. 3 is a front perspective view of a turbine of embodiments of the disclosed technology. FIG. 5 is a rear perspective view of the turbine of FIG. 3. In this embodiment, the turbine 11 has a top plate 14 and a bottom plate 19. A top-most edge of each blade 13 is flush with an inner side of the top plate 14, and a bottom-most edge of each blade 13 is flush with an inner side of the bottom plate 19.

A shaft 15 extends from the central point of the turbine 11 and passes through holes in both plates and shaft 15 connects to casing bearings 34 on either side of those plates.

"Horizontal" is defined as lying in a plane in which an upper surface of the top platelies and/or in a plane parallel thereto. "Vertical" is defined as lying in any plane perpendicular to the horizontal plane.

The casing rotation control 37 has an upper portion 38 and a lower portion 31 which are connected by a shaft 39. In the embodiment shown, the upper portion 38 and the lower portion 31 are spaced-apart with a shaft 39 there-between. In other embodiments, the shaft 39 may be shorter than the shaft 39 in the figure shown. The upper portion 38 and the lower portion 31 are cylindrical in shape. In the embodiment shown, a circumference of the upper portion 38 is smaller than a circumference of the lower portion 31. In other embodiments, the circumference of the upper portion 31 is smaller than the circumference of the lower portion 38. In embodiments, the casing rotation control 37 is fixed relative to the casing 30. "Upper", "lower", "top", and "bottom" are defined such that an uppermost part of the turbine 11 (not taking into account the shaft 15) is a point within the edge of the top plate 14 furthest from an interior of the turbine 11 and a bottommost part of the turbine 11 (not taking into account the shaft 15) is a point within the edge of the bottom plate 19 furthest from an interior of the turbine 11.

Figure 12:
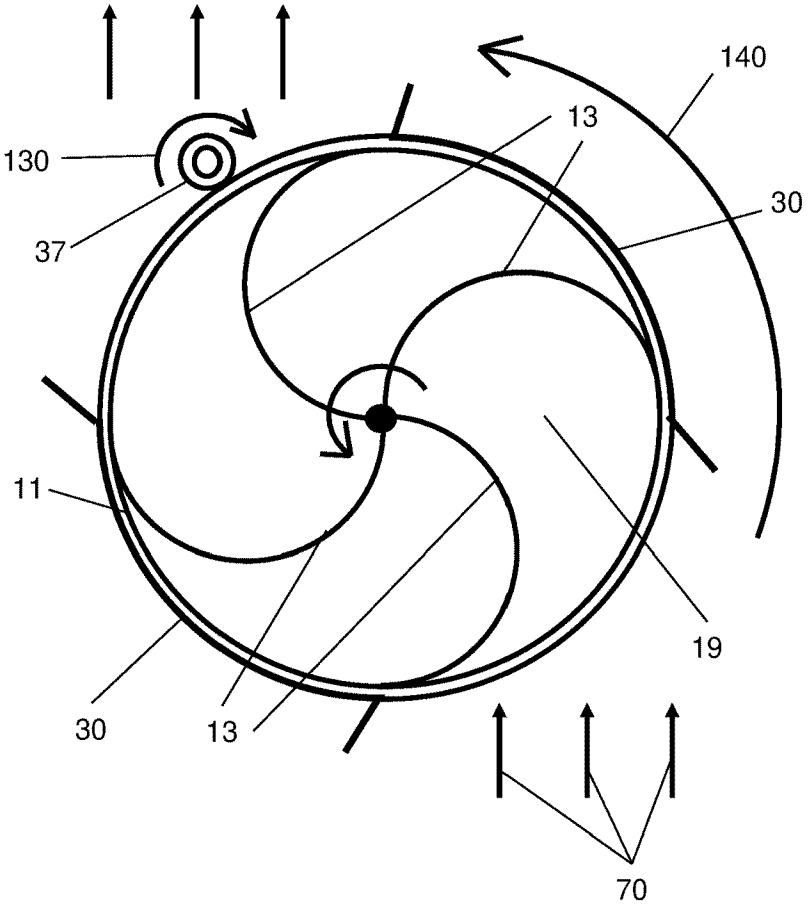
FIG. 12 is a top plan view of the turbine of FIG. 6 with arrows showing a direction of fluid flow there-about and rotation(s) thereof.
Figure 11:
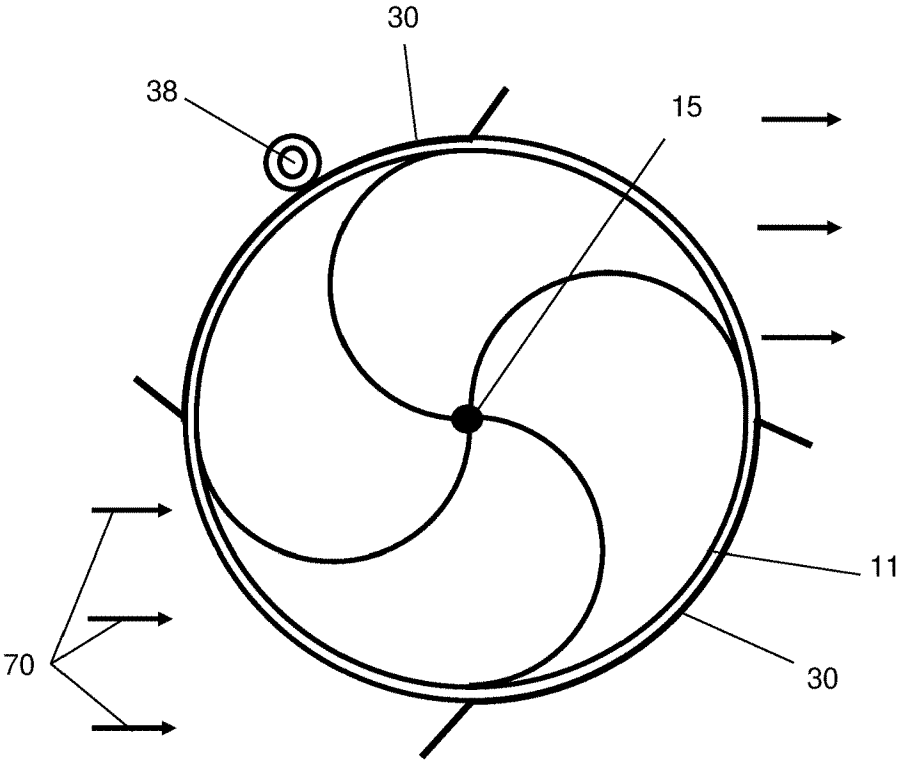
FIG. 11 is a top plan view of the turbine of FIG. 6 with arrows showing a direction of fluid flow there-about.
Figure 14:
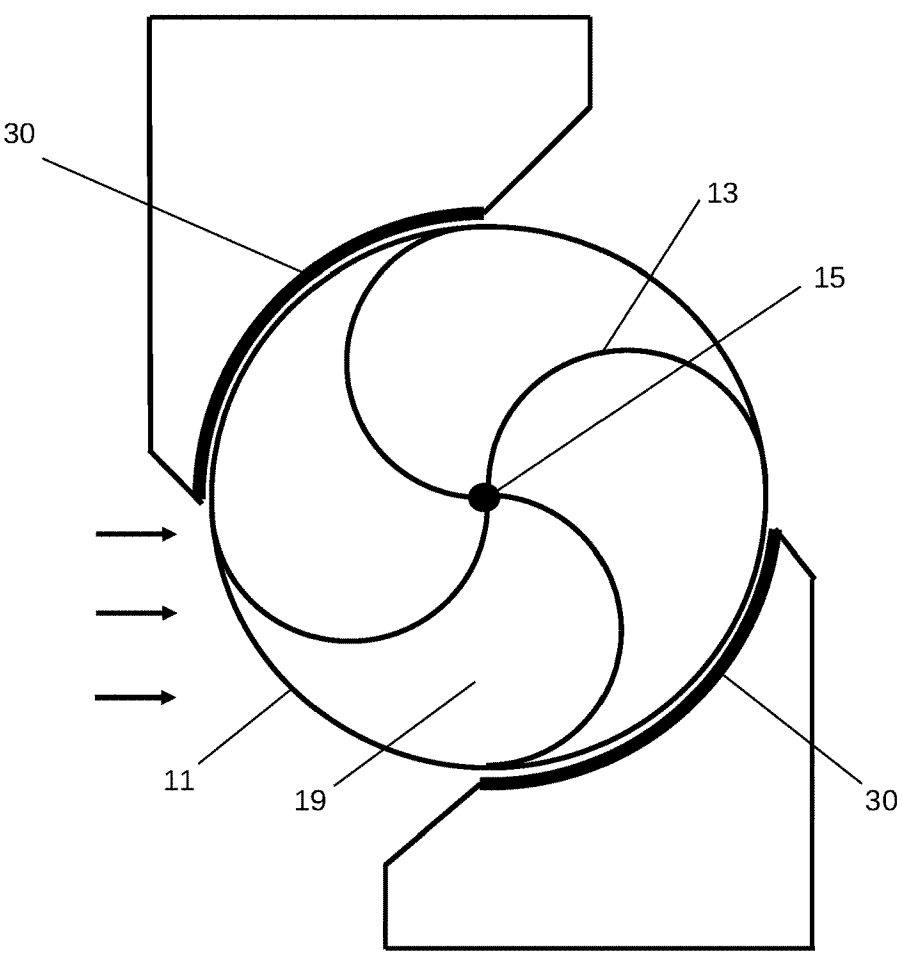
FIG. 14 is a top plan view of a permanent installation with shaft on top turbine of embodiments of the disclosed technology.
Figure 13:
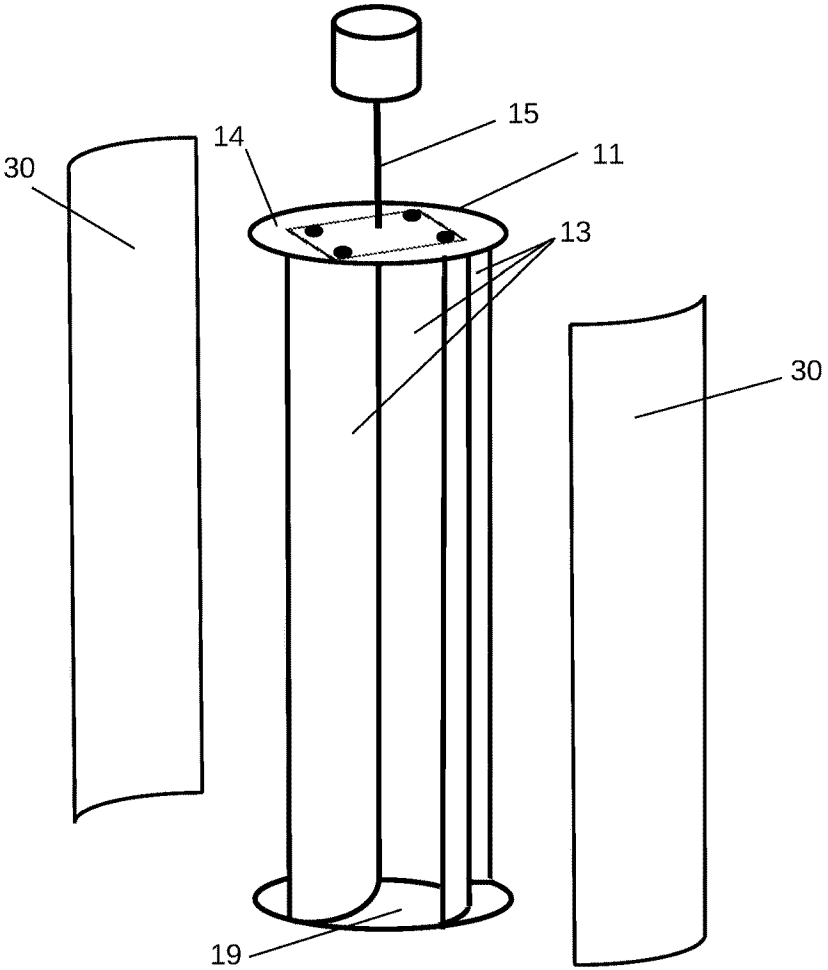
FIG. 13 is a front perspective view of a permanent installation with shaft on top turbine of embodiments of the disclosed technology.

FIG. 11 is a top plan view of the turbine of FIG. 3 with arrows showing a direction of fluid flow there-about. FIG. 12 is a top plan view of the turbine of FIG. 3 with arrows showing a direction of fluid flow there-about and rotation(s) thereof. The incoming fluid flow has a direction 70. The direction of the incoming fluid flow 70 is detected by the turbine 11. In some embodiments, the direction of the incoming fluid flow 70 is detected by a component of the casing rotation control 37. In some embodiments, the direction of the incoming fluid flow 70 is detected by a resulting spin of a component of the casing rotation control 37 about a central point thereof.

When the direction of the incoming fluid flow 70 changes, the turbine 11 rotates about its central point 15 along a rotational vector 140 and the casing rotation control 37 rotates about its central point along a rotational vector 130. In the embodiment shown, the casing rotation control 37 is fixed relative to the turbine 11 and rotates in a direction opposite that of the turbine 11. In other embodiments, the casing rotation control 37 is fixed to the rail 40 and a central point of the casing rotation control 37 is stationary along with turbine shaft 15.

In some embodiments, the rotation of the turbine 11 is determined by the rotation of the casing rotation control 37. The casing 30 may be rotated by the rotation of the casing rotation control 37 by means of gears and/or a belt and/or the like (not shown). The rotation of the casing rotation control 37 may be caused by the direction 120. The rotation of the casing rotation control 37 may be caused by movement of a motor 38 based on the detected direction of the incoming fluid flow 120.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A turbine comprising:

a plurality of internal blades;

a two-part rotatable casing;

a top plate;

a bottom plate;

a turbine shaft; and a casing rotation control including an upper portion and a lower portion connected by a second shaft[1], the casing rotation control coupled to the two-part rotatable casing[2], the casing rotation control rotating the two-part rotatable casing about a central point of the two-part rotatable casing[3], the casing rotation control fixed relative to the turbine and rotating in the opposite direction of the turbine[4];

wherein each part of said rotatable casing is spaced apart from one another and extends between said top plate and said bottom plate, forming a substantially water tight seal there-between.

2. The turbine of claim 1, wherein said casing comprises two separate, oppositely-disposed concave arcs of a same circle, each respective arc forming a unitary structure with a respective convex arc;

wherein each respective convex arc is smaller than a respective concave arc.

3. The turbine of claim 2, wherein said casing is functionally connected to said turbine, such that said casing rotates with a same rotational axis as said turbine;

wherein said turbine rotates such that said concave portions of said casing face an area of flow of relatively higher pressure and said convex portions of said casing face an area of flow of relatively lower pressure compared to said area of flow of relatively higher pressure.

4. The turbine of claim 1, wherein said casing comprises two openings:

an inlet; and an outlet;

wherein said inlet and said outlet are oppositely disposed; and wherein a distance between a first side edge of said inlet and an adjacent side of said outlet is shorter than a distance between a second side edge of said inlet and an adjacent side of said outlet.

5. The turbine of claim 4, wherein said turbine rotates in response to a measured direction of flow of fluid.

6. The turbine of claim 5, wherein said casing rotation control causes said turbine to rotate based on detecting a water flow direction and mechanically rotating said casing.

7. The turbine of claim 6, wherein said casing rotation control causes said turbine to rotate such that said inlet faces an incoming flow of fluid.

8. The turbine of claim 4, wherein said casing comprises two separate, oppositely-disposed concave arcs of a same circle, each respective arc forming a unitary structure with a respective convex arc;

wherein said outlet comprises a space between said two convex arcs; and wherein said inlet comprises a space between endpoints of said two separate, oppositely-disposed concave arcs of said same circle opposite said convex arcs.

9. The turbine of claim 8, wherein said casing further comprises a pair of other concave arcs, each of the other concave arcs connected at an endpoint to an endpoint of a concave arc of said casing opposite said convex arc of said concave arc of said casing;

wherein said other concave arcs are rotatable about a point of connection to a respective concave arc of said casing;

wherein said other concave arcs, when in a closed position, form an unbroken arc with both said concave arcs of said casing;

wherein said other concave arcs, when in an open position, form an acute angle with a respective adjacent concave arc of said casing; and wherein each of said other concave arcs are directly connected to said endpoint of said concave arc defining flaps that protrude outwardly from the casing.

10. The turbine of claim 1, wherein said turbine is fixed at least one point, such that it moves at a velocity which is lower than that of a surrounding fluid medium.

11. The turbine of claim 1, wherein the casing rotation control stops the turbine by turning the two-part rotatable casing to block water flow to the back of the advancing blade.

* * * * *